US006543097B2

(12) United States Patent
Burt et al.

(10) Patent No.: US 6,543,097 B2
(45) Date of Patent: Apr. 8, 2003

(54) SLIDE FASTENING DEVICE FOR SPORTS ARTICLE, AND SPORTS ARTICLE EQUIPPED WITH SUCH DEVICE

(75) Inventors: Igor Burt, Boulder, CO (US); Thomas Goff, Englewood, CO (US)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/822,461

(22) Filed: Apr. 2, 2001

(65) Prior Publication Data

US 2001/0032378 A1 Oct. 25, 2001

(30) Foreign Application Priority Data

Apr. 3, 2000 (FR) ..... 00 04372

(51) Int. Cl.[7] ..... A43C 11/00; A44B 18/00; A44B 11/12; B65D 63/00

(52) U.S. Cl. ..... 24/170; 24/17 AP; 24/196; 24/306; 24/442; 36/50.1

(58) Field of Search ..... 24/170, 196, 306, 24/442, 17 AP; 36/50.1

(56) References Cited

U.S. PATENT DOCUMENTS

| | | | | | |
|---|---|---|---|---|---|
| 1,456,580 | A | | 5/1923 | Sullivan | |
| 1,678,241 | A | | 7/1928 | Benz | |
| 2,826,796 | A | * | 3/1958 | Davis | 24/170 |
| 2,935,798 | A | | 5/1960 | Piberhofer | 36/2.5 |
| 3,678,542 | A | * | 7/1972 | Prete, Jr. | 24/170 |
| 4,800,595 | A | | 1/1989 | Askew | 2/270 |
| 5,431,317 | A | * | 7/1995 | Kliot | 224/153 |
| 5,450,660 | A | | 9/1995 | Frano | 24/585 |
| 5,487,374 | A | * | 1/1996 | Herminath et al. | 124/86 |
| 5,548,871 | A | * | 8/1996 | Trethewey | 24/306 |
| 5,582,337 | A | * | 12/1996 | McPherson et al. | 24/306 |
| 5,644,822 | A | * | 7/1997 | Frew | 24/196 |
| 5,660,312 | A | * | 8/1997 | Suzuki | 224/627 |
| 5,727,337 | A | * | 3/1998 | Okajima | 36/50.1 |
| 5,794,360 | A | * | 8/1998 | Bell et al. | 24/306 |
| 5,852,852 | A | * | 12/1998 | Rigal | 24/68 SK |
| 5,898,947 | A | | 5/1999 | Page | 2/237 |
| 5,950,893 | A | * | 9/1999 | Heggeland | 224/578 |
| 5,997,039 | A | * | 12/1999 | Manninen | 24/196 |

FOREIGN PATENT DOCUMENTS

| | | | | |
|---|---|---|---|---|
| DE | 825681 | | 4/1952 | |
| DE | 865284 | | 2/1953 | |
| DE | 3506896 | * | 8/1986 | 24/170 |
| DE | 10007979 | | 8/2001 | |
| FR | 2637785 | | 4/1990 | |
| FR | 2723522 | | 2/1996 | |
| GB | 374760 | | 6/1932 | |
| GB | 513735 | | 10/1939 | |
| JP | 6346305 | * | 12/1994 | 24/170 |

* cited by examiner

*Primary Examiner*—Victor Sakran
(74) *Attorney, Agent, or Firm*—Greenblum & Bernstein, P.L.C.

(57) ABSTRACT

A fastening device for a sports article including two portions adapted to be brought closer together. This device which serves to tighten a foot, a wrist, but also a content can be used on an article of footwear, a garment, a backpack, etc. The device includes a strap, one end of which is connected to a first portion of the sports article, which passes in a return connected to a second portion of the sports article. The strap defines a portion between the end of the strap and the return. The device also includes a blocking mechanism, fixed to a second end of the strap, which cooperates with the portion of the strap for the fastening. The blocking mechanism is slidably mounted on the portion of the strap.

37 Claims, 5 Drawing Sheets

SLIDE FASTENING DEVICE FOR SPORTS ARTICLE, AND SPORTS ARTICLE EQUIPPED WITH SUCH DEVICE

BACKGROUND OF THE INVENTION

1. Field of the Invention

The present invention relates to a fastening device for a sports product or an article of clothing, such as footwear or garments, although not particularly limited thereto. The invention also relates to a sports product or article of clothing which incorporates such fastening device.

2. Description of Background and Relevant Information

Fastening systems of the type having a strap are known, for example, in rigid boots used on skis, snowboards, in-line roller skates, etc., in particular for tightening the tibia of the leg. Generally speaking, it is a strap provided with a self-gripping fastener, i.e., a hook-and-loop fastener, that is passed in a return and is fixed on itself by forming a loop. However, the self-gripping fastener loses its effectiveness upon contact with sand or snow which get caught in the micro-hooks constituting the fastener. Furthermore, the micro-hooks of such a fastener are aggressive and can deteriorate the more fragile portions, such as the textiles, for example, coming in contact with the latter.

U.S. Pat. No. 1,678,241 discloses a shoe-fastening arrangement that includes a strap passing through an eyelet and closing on the boot upper. However, the snap fastening device does not allow any adjustability.

U.S. Pat. No. 5,450,660 describes fastening a sandal by a strap. The strap, which tightens the foot, is passed in a return and is led back and fixed on itself, in the area of a notched track. However, the fastening is imprecise because of the predetermined adjusting positions on the notched track. Moreover, the notched track stiffens the strap. There are also sandals that have a strap fastening device where the fastening is done in a known fashion by a strap which is blocked in a notched buckle. The tension is maintained by friction of the notches on the strap. In this way, the adjusting is well proportioned; however, the free end of the strap dangles in a dangerous and unaesthetic manner. This phenomenon is accentuated if one intends to provide an article of footwear having a wide fastening range such that it adapts to feet of various lengths and volumes.

SUMMARY OF THE INVENTION

One of the objects of the present invention is to propose a strap fastening device that makes it possible to resolve the aforementioned problems, in particular to properly apportion the fastening tension, and to provide a substantial fastening range while avoiding the problem of a dangling free strap and minimizing the stiffening of the strap.

Another object of the invention is to propose a device that is simple and not susceptible to deterioration by sand, snow, and other dirt.

To achieve these objects, the device for fastening two portions of a sports or clothing article includes a strap, one end of which is connected to one of the portions of the article to be brought closer together. This strap passes in a return which is connected to the other portion of the sports article, and thus defines a first strap portion. According to the invention, the other end of the strap is connected to a blocking mechanism that is slidably mounted on the first strap portion and cooperates with the latter for blocking movement of the strap. This construction guarantees great adjustability because the entire first strap portion can be used for the adjusting, without stiffening the system. Furthermore, the return of the strap over itself and the cooperation of the blocking mechanism with the first strap portion enable an automatic retraction of the length of the strap corresponding to the fastening, and exclude any possibility of a dangling free strap.

In a first embodiment, the blocking mechanism is obtained by a buckle, having at least one crosspiece, which frictionally holds the strap in a fastening position.

In a second embodiment, the blocking mechanism pinches the strap either by deformation of an elastic piece, or by a wedging element so as to avoid any problem of ill-timed loosening.

In a third embodiment, the blocking mechanism cooperates with notches positioned on the strap.

All of the embodiments can be improved by providing them with a snap buckle.

BRIEF DESCRIPTION OF DRAWINGS

The invention will be better understood and other advantages thereof will become apparent from the description that follows, with reference to the annexed schematic drawings. The description shows, by way of non-limiting examples, certain preferred embodiments.

DETAILED DESCRIPTION OF THE INVENTION

Figure 1:
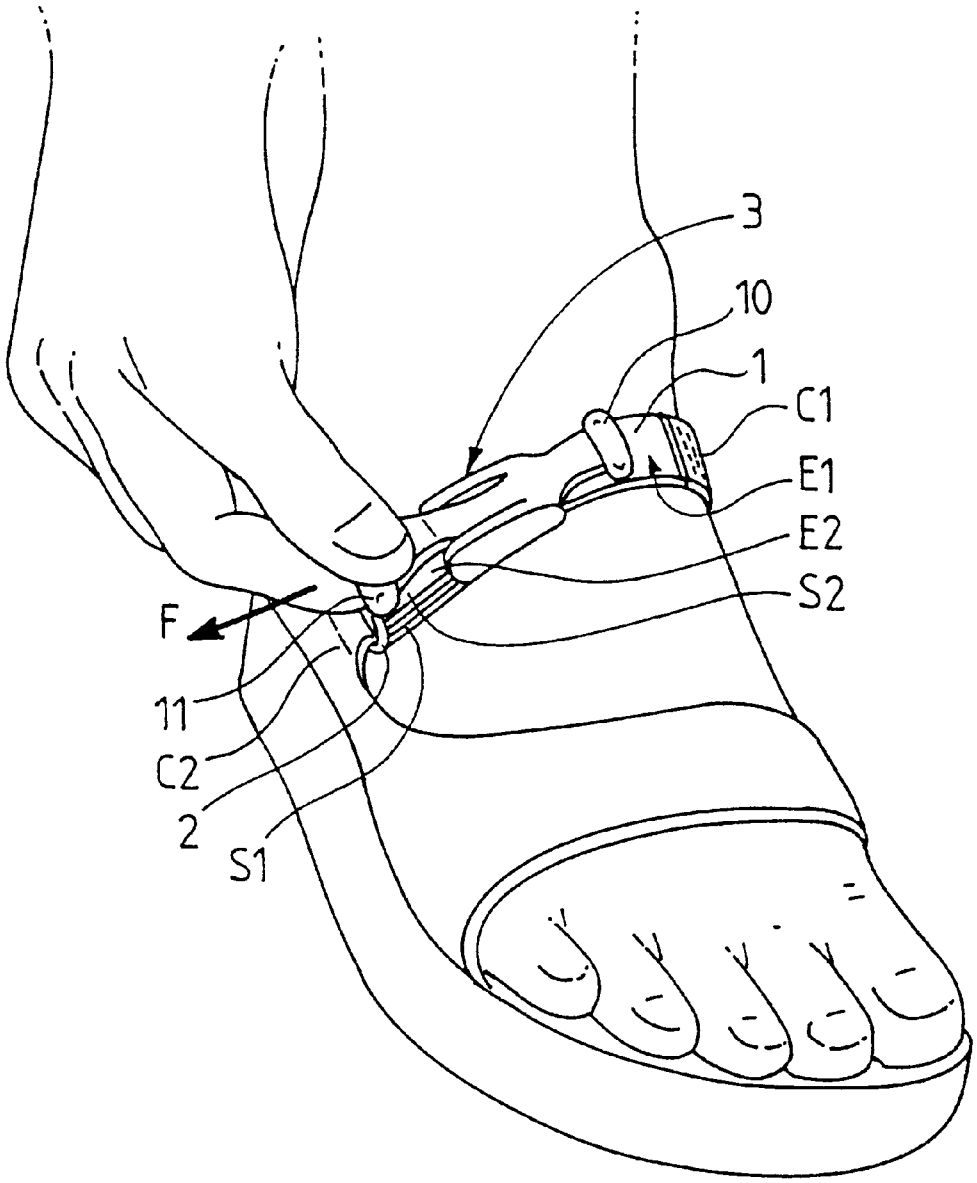
FIG. 1 schematically shows an article of footwear equipped with the fastening device.

FIG. 1 shows the strap fastening device of the invention applied to an article of footwear. In this figure, the article of footwear is a sandal, constituted of a sole and two series of bands or portions C1, C2 fixed relative to the sole and adapted to maintain the position of the foot. The sandal includes the fastening device arranged or interposed between the two transversely spaced apart bands C1, C2 to maintain and fasten the instep by bringing the band C1 of the sandal closer to the other band C2. The band C2 of the upper is connected to a return 2 which, in this case, is constituted by a buckle, through which a strap 1, extending from the band C1, passes. The end E1 of the strap 1 is fixed to the portion C1 by known means for attachment, such as stitching. The portion S2 of the strap 1, which extends from the return 2, is connected, in the area of its end E2, to a blocking device 3 provided with a pull-tab 11. In addition, the portion S2 is positioned above the portion S1. This device 3 is slidably mounted on the portion S1 of the strap 1 which is comprised between the end E1 and the return 2.

The blocking device 3 can be displaced by the user who manually pulls on the pull-tab 11 along a direction F generally oriented toward the return 2. This action, shown in FIG. 1, makes it possible to reduce the portion S2 of the strap 1, and therefore to loosen the device. Conversely, to achieve a fastening, the user pulls on the pull-tab 10 substantially along the direction opposite the direction F, and displaces the blocking mechanism so as to lengthen the portion S2 of the strap 1. This lengthening causes a shortening of the portion S1 of the strap 1, and it is this shortening that ensures the fastening and therefore the holding of the foot.

The variation in length of the portion S1 is automatically retracted by the variation in length of the portion S2 due to the balancing of tension produced by the return 2. Thus, the strap 1 does not have a loose or dangling portion, as is usually the case encountered in prior art when the existing devices are fastened.

Figure 2:
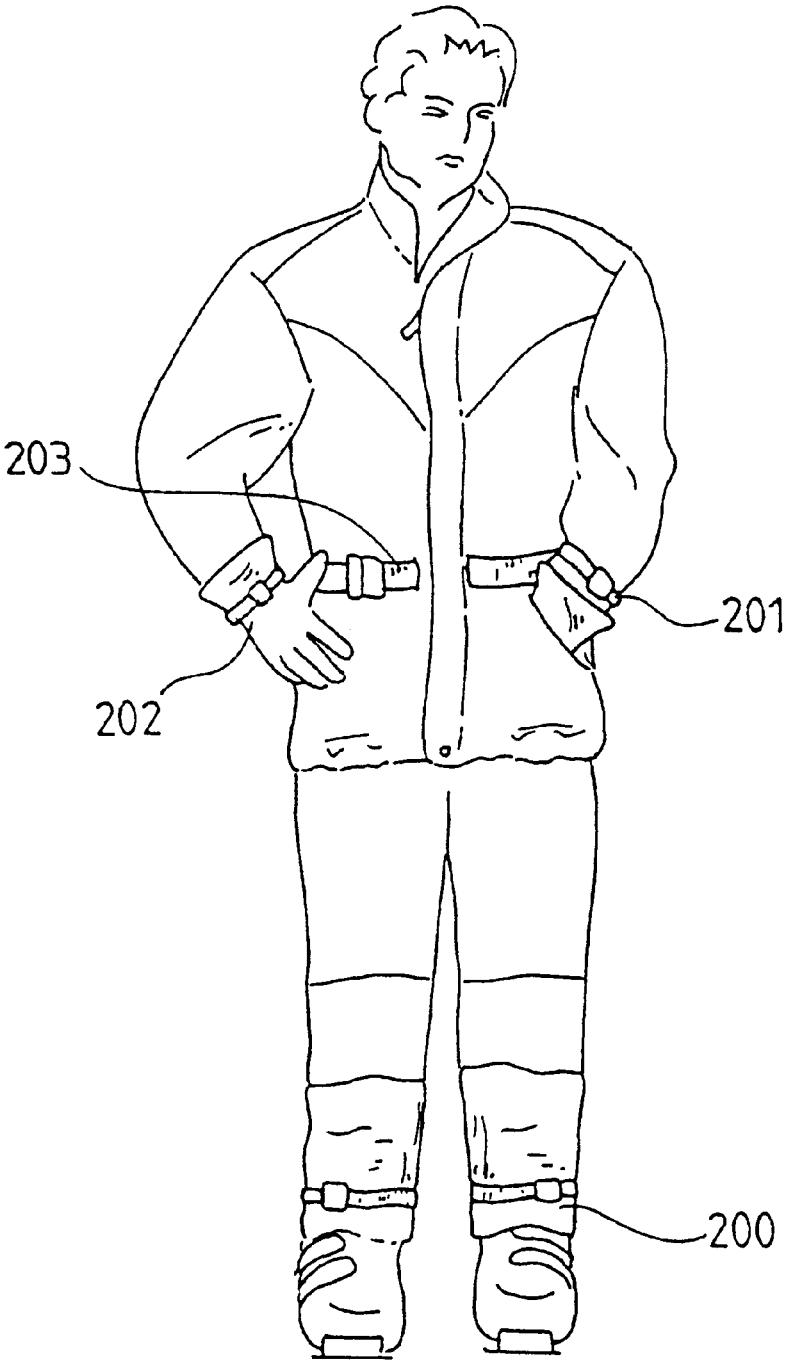
FIG. 2 schematically shows a user wearing garments equipped with the fastening device.

FIG. 2 shows examples of the application of the fastening device of the invention for use with textile products, sports and outdoor casual garments in particular. An advantage offered by the invention in this application is aesthetic, due to the fact that the device provides a self-retraction of the strap as described previously. The fastening device can advantageously be arranged on trousers or overalls, at the bottom of at least one leg 200 to tighten the garment around the leg, or around a sports boot, in particular, such as a ski boot or snowboard boot, so as to provide a complete imperviousness to water, snow, mud, etc.

The fastening device can also be positioned at the bottom of at least one sleeve 201 of a jacket. At this location, it is possible to tighten the garment on the gloves and to provide a complete imperviousness to the wind or against the gloves. The fastening device can also be arranged on the gloves 202 themselves to ensure that the glove is fastened and held around the wrist. Moreover, it is contemplated that the device could be arranged in the area of the belt 203 of the jacket by allowing the garment to be adjusted to the size of the user.

In these various applications to textiles products, it is preferred to position the fastening device outside of the garment, so that the device functions for fastening and not merely for adjusting. Indeed, the user first slips on his/her garment before adjusting it by actuating the fastening device.

FIGS. 3–10 show more technical detailed diagrams of various embodiments of the fastening devices according to the invention.

Figure 3:
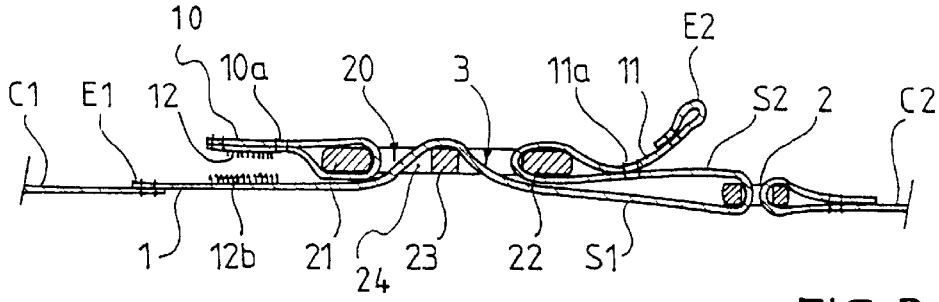
FIG. 3 schematically shows a longitudinal cross-section of the fastening device according to the first embodiment.
Figure 4A:
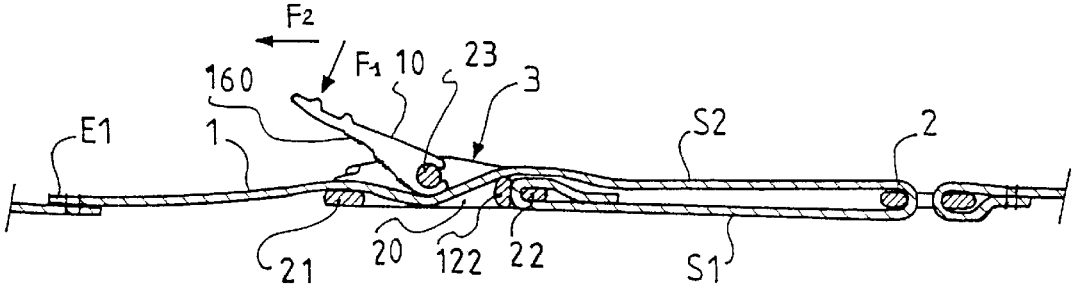
FIG. 4A schematically shows a longitudinal cross-section of the fastening device according to a variation of the first embodiment.
Figure 4B:
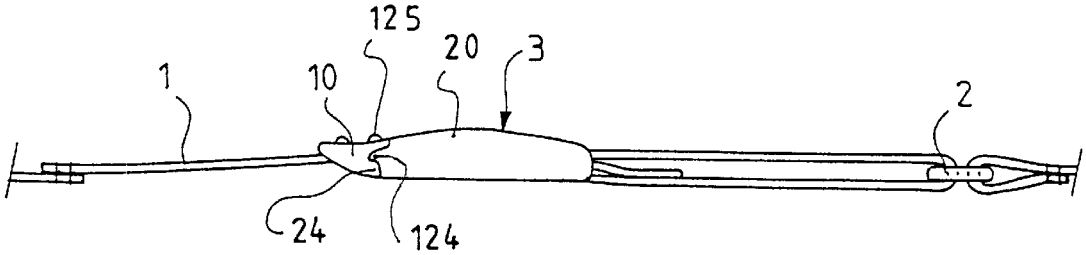
FIG. 4B shows a side view of the preceding alternative embodiment.
Figure 4C:
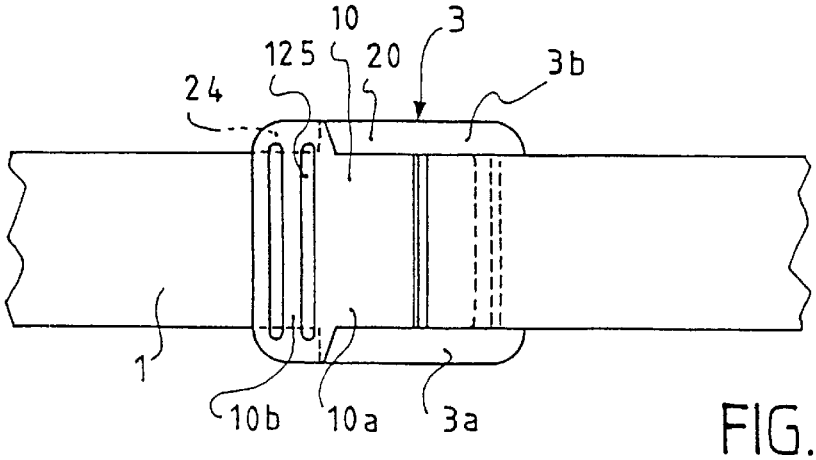
FIG. 4C shows a top view of this same alternative embodiment.

FIGS. 3–4C show two first embodiments in which the blocking mechanism 3 is provided with a buckle 20 including at least one crosspiece 23.

In FIG. 3, the buckle 20 shown is a known strap-adjusting buckle having a substantially rectangular shape. It includes two edges 21, 22 between which a crosspiece 23 is inserted. All these elements 21, 22, 23 are arranged substantially parallel, and the crosspiece 23 is arranged substantially at an equal distance from the two edges 21, 22. Moreover, the elements 21, 22, 23 are maintained affixed by at least one longitudinal member 24. The buckle 20, which constitutes the blocking mechanism 3, is slidably mounted on a portion S1 of the strap 1 which is defined between a first end E1 of the strap 1 and the return 2. The end E1 and the return 2 are connected, to the portions C1 and C2, respectively, which are adapted to be brought closer together by the fastening device. The sliding is obtained by the specific trajectory of the strap 1 in the buckle 20.

The strap 1 extends through the buckle 20 by passing on both sides of the crosspiece 23 so that it covers the edges 21, 22 on the same side of the buckle 20, and so that it covers the crosspiece 23 on the opposite side of the buckle 20. This trajectory of the strap 1 in the buckle 20 also ensures the frictional blocking of the blocking mechanism 3 on the strap 1. Indeed, when the strap 1 is tensioned, it exerts a pressure perpendicular to the buckle 20 on the edges 21, 22 and on the crosspiece 23. This pressure generates friction between the strap 1 and the material constituting the buckle 20, which can be an elastic material such as a polyamide, for example. These friction forces can also be generated by the strap on itself, because the portion S2 of the strap 1, which is fixed to the edge 22 of the buckle 20, and thus covers the constituent material of the edge 22, is itself in contact with the strap portion S1.

To actuate the fastening device, it is necessary to slide the buckle 20 toward the end E1 of the strap 1, along the portion S1 of the latter. This displacement produces a lengthening of the portion S2 of the strap 1 which, due to the sliding in the return 2, causes a shortening, by the same value, of the portion S1 of the strap 1. This shortening brings the portions C1 and C2 closer together, which produces the fastening, and therefore the desired holding by the fastening device.

This indirect mechanism for retracting the strap functions because the strap 1 has a constant length. However, it continues to function if the strap 1 is elastic because the return 2 balances the tensions between the portions S1 and S2 of the strap 1. Indeed, even if the retraction of the strap 1 in an area is locally absorbed by a lengthening of the strap 1, this lengthening is also distributed between the portions S1 and S2. When the displacement of the buckle 20 is completed, the retraction of the strap 1 is therefore also distributed between the portions S1 and S2 and the device ensures its fastening function.

Therefore, one can advantageously use a strap 1 that has an elastic characteristic, for example an elastic band. Similarly, one can use a non-elastic strap 1 and combine it with another strap, having an elastic characteristic, that connects the return 2 to the portion C2 of the sports article. This elasticity procures comfort in the fastening device, especially around the sensitive points of the body such as the foot, wrists, etc.

The manual displacement of the blocking device 3 is facilitated by the addition of at least one pull-tab 10 which makes it possible, by virtue of an improved grip, to slide the blocking device 3 on the strap 1, and to thus bring the portions C1 and C2 closer together for the fastening. The pull-tab 10 is positioned on the edge 21 of the buckle 20. For example, it can be obtained by a strap that surrounds the edge 21, and which forms a loop closed by a stitched seam 10*a*. This loop can advantageously be provided with a piece that facilitates the manual grasping of the loop, and which can be a piece of leather, for example.

Likewise, the other end of the blocking mechanism 3 can be associated with a pull-tab 11 that makes it possible, by an improved grip, to slide the blocking mechanism 3 on the strap 1, and to thus space the portions C1 and C2 apart for the loosening. The force exerted by the user occurs along a direction substantially opposite that exerted on the pull-tab 10. This pull-tab 11 can advantageously be obtained by an extension of the strap 1, as shown in FIG. 3. The strap 1, in the portion S2, is in this case fixed to the edge 22 of the buckle 20 so as to form a loop around the edge 22, closed by the stitched seam 11*a*. This loop is extended by the end E2 of the strap 1 which forms the pull-tab 11. This construction is obtained by sliding the strap 1 between the portion S1 and the edge 22 of the buckle 20, and by surrounding the edge 22. Thus, the end E2 of the strap 1 is located on the opposite side of the device with respect to the side that is in contact with the object to be tightened. Likewise, the pull-tab 11 can be provided with an attached piece, in particular made of leather to facilitate the grip thereof.

Advantageously, at least one pull-tab 10, 11 can include a hooking surface 12, complementary of the hooking surface 12*b* arranged on the strap 1 or on the sports article, and more specifically the portions C1 and C2. These hooking surfaces 12, 12*b*, which can be of the self-gripping type, i.e., hook-and-loop fastener type, make it possible to ensure an additional holding of the pull-tab 10, 11 and to constitute a safety measure against a possible loosening of the device that can be caused by a sliding of the blocking mechanism 3 on the strap 1.

In this first embodiment, the choice of the strap 1 is essential. Indeed, the blocking mechanism 3 that blocks by friction also serves to slide the end E2 of the strap 1. Depending upon whether one seeks to emphasize the blocking strength or the sliding, the coefficient of friction of the strap 1 used can be advantageously modified. For example, the strap 1 can be made of woven textile. However, existing straps do not offer much varied coefficients of friction. To adjust the coefficient of friction at best, the strap 1 can include a band, fixed on the strap 1, which has a frictional or sliding characteristic. This band is fixed by an adhesive or by heat on the surface of the strap 1 that is in frictional contact with the buckle 20.

Advantageously, this strap can be manufactured specifically for this use, and can combine a mixture of material during manufacture to achieve the desired coefficient of friction. For example, the weft threads can be made of a different material on the central portion with respect to the remainder of the strap.

In a first variation of this embodiment, the pull-tabs 10, 11 are independent of the strap 1. To achieve this objective, the buckle must include at least two crosspieces as well as two edges. Thus, each edge or crosspiece constitutes a fastening point for a pull-tab or a strap end, or a winding point for the strap that extends through the buckle on both sides.

A second variation consists of positioning a single pull-tab which simultaneously ensures the gripping function for tightening and loosening the device. The pull-tab is then fixed on the crosspiece 23 of the buckle 20. In order for the pull-tab to be accessed, the passage of the strap 1 in the buckle 20 is inverted with respect to FIG. 3. The strap 1, in the portion S1, passes beneath the crosspiece 23 and above the edges 21, 22. Thus, the pull-tab can pivot around the crosspiece 23 so as to be inclined toward the left or toward the right, and enable the displacement of the buckle 20 to tighten or loosen, respectively.

The following descriptions, with reference to FIGS. 4A–10, essentially are directed to the blocking mechanism. They do not necessarily repeat the functioning of the fastening device with the passage of the strap in the return when the latter is identical to the previous description in relation to FIG. 1.

FIGS. 4A, 4B, 4C show an improvement to the second variation previously described, in the area of the pull-tab 10. The improvement includes making a specific buckle 20 that includes a crosspiece 23 and edges 21, 22, but also a pull-tab 10 which includes a hooking surface to perfect the blocking of the strap 1.

In FIG. 4A, the pull-tab 10, which is pivotally mounted on the crosspiece 23 of the buckle 20, is in the open position to enable the sliding of the buckle 20 on the portion S1 of the strap 1. The pull-tab 10 includes teeth 160 that are located on the surface of the pull-tab 10 that is adapted to be folded back on the portion S1 of the strap 1. Thus, when the pull-tab 10 is in the closed position, the pull-tab 10 pinches the strap 1 against one of the edges 21, 22 of the buckle 20. The teeth 160 then penetrate into the strap 1 and frictionally reinforce the action of the blocking mechanism 3. The teeth 160 are preferably arranged transversely to the pull-tab 10 and longitudinally on the portion of the pull-tab 10 facing the edge 21 of the buckle 20, when the pull-tab 10 is in the lowered position. The pull-tab 10 can advantageously be folded back on the edge 21 of the buckle 20. Thus, the force F1, exerted by the user to block the device, has a horizontal component F2 that is oriented toward the end E1 of the strap 1. This component F2 therefore contributes to the fastening of the system. A reverse geometry is also contemplated according to the invention. Furthermore, the buckle 20 can advantageously include a crosspiece 122 positioned between the crosspiece 23 and the edge 22. It has a greater height than the height of the edge 22 increased with twice the thickness of the strap 1. Thus, the strap 1, in its portion S2 that is located above the portion S1, rubs on the crosspiece 122 and not on the portion of the strap 1 that surrounds the edge 22, and the sliding is therefore facilitated.

In FIG. 4B, the pull-tab 10 is lowered and therefore the blocking mechanism 3 is in the position for blocking the strap 1. The blocking mechanism 3 still functions by friction on the strap 1 as described previously in the main application of the first embodiment. However, one seeks to perfect the blocking in order to avoid any undesired sliding. To achieve this object, it is necessary to firmly hold the pull-tab 10 against the buckle 20. Therefore, the pull-tab 10 has, at its end, a hooking structure 24 that is complementary to a retaining structure 124 fixed on the buckle 20. This cooperation of the structures 24 and 124 is such that it makes it possible to ensure a removable closure. This complementarity of structures can be obtained by a hooking structure 24 that includes a protuberance complementary of a housing obtained in the buckle 20. The housing then represents the retaining structure 124. The unblocking of this closure is then ensured by an elastic deformation of the constituent material of the protuberance 24. Therefore, the pull-tab 10 and the buckle 20 can advantageously be made of a plastic material, such as a polyamide which is rigid while maintaining a certain elasticity.

In FIG. 4C, the blocking mechanism 3 is shown in a top view. In order to obtain as compact a blocking mechanism 3 as possible, the pull-tab 10 includes two portions. These two portions include a narrow portion 10*a* having a length substantially identical to the width of the strap 1 that is located on the side of the crosspiece 23, and which is nested in the buckle 20 between the protuberances 3*a* and 3*b* of the buckle 20, and a wide portion 10*b* having a width substantially identical to the width of the buckle 20. Outside the location of the strap 1, the wide portion 10*b* laterally has the hooking structure 24 such as previously described. This hooking structure 24 can advantageously be split in a substantially symmetrical manner with respect to the strap 1. Moreover, the wide portion 10*b* can advantageously include on its upper surface at least one projection 125, which extends transversely with respect to the pull-tab 10, and which is adapted to improve the grip, manually or with gloves, of the pull-tab 10.

Figure 5:
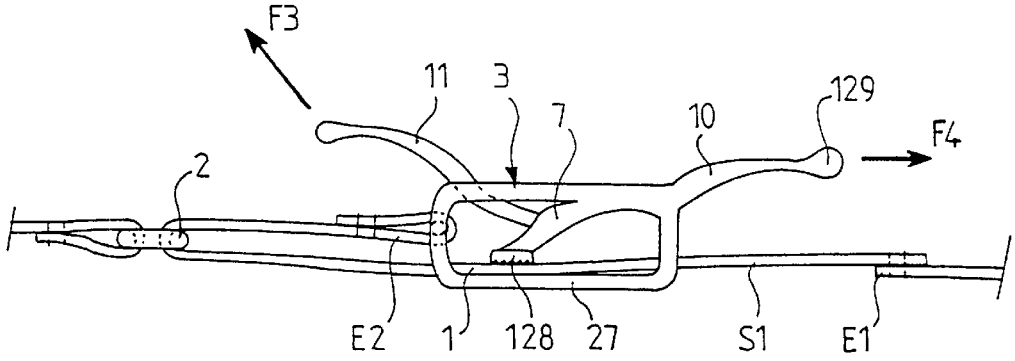
FIG. 5 schematically shows a longitudinal cross-section of the fastening device according to a second embodiment.

FIG. 5 shows a second embodiment of the fastening device in which the strap 1 is pinched by a flexible blade 7. The flexible blade 7 is integrated into the blocking mechanism 3 which is connected to the end E2 of the strap 1.

The flexible blade 7 is mounted on the top portion of the blocking mechanism 3, which includes a supporting base 27 in its lower portion. The strap 1 is maintained by pinching between the supporting base 27 and the flexible blade 7. To perfect the blocking of the strap 1 by pinching, the flexible blade 7 includes at its lower end at least one tooth 128 which is nested in the strap 1 under the effect of the elastic action of the blade 7 which is directed downward. Moreover, the flexible blade 7 emphasizes a direction of displacement of the blocking mechanism 3 along which the blade rises spontaneously under the action of the displacement. In the preferred embodiment shown, the flexible blade 7 is inclined downward and toward the return 2. Thus, when a force F4 is exerted substantially parallel to the portion S1 of the strap 1, the blocking mechanism slides on the strap 1 and tightens the device on the strap 1. Indeed, the force F4 opposes the elastic return of the flexible blade 7 because the pull-tab 10 is fixed on the blocking mechanism 3 on the side opposite the return 2. Conversely, if an attempt is made to slide the blocking mechanism 3 toward the return 2, the short displacement generated nests the teeth 128 into the strap 1. Indeed, the short displacement reinforces the action of the elastic return of the flexible blade 7 on the strap 1. To loosen the device, it is necessary to exert a force F3 on the pull-tab 11 which is connected to the flexible blade 7. The action F3 of the user is oriented upward and toward the return 2; thus, the user lifts the blade 7 to release the teeth 128 from the strap 1, then, by maintaining it raised, slides the blocking mechanism 3 toward the return 2.

The device can be inverted by inclining the flexible blade 7 toward the end E1 of the strap 1 and downward, but this constructional arrangement emphasizes the ease of loosening with respect to the fastening.

The pull-tabs 10, 11 can be provided advantageously with a protuberance 129 which is located at the end of the pull-tab 10, 11, and which facilitates the manual grip, possibly with gloves, of the pull-tab 10, 11.

Figure 6:
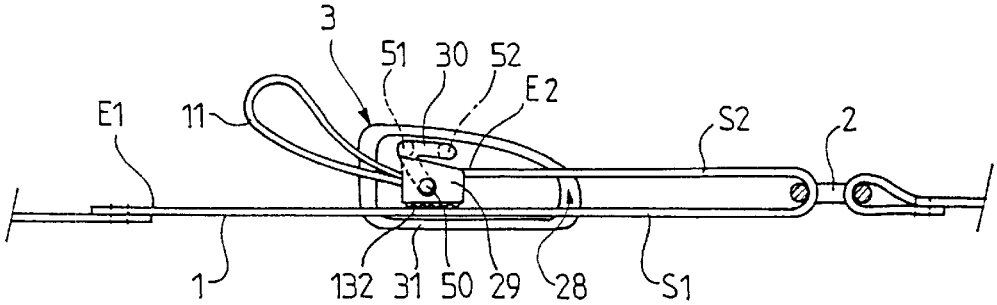
FIG. 6 schematically shows a longitudinal cross-section of the fastening device according to a first variation of the second embodiment.

FIG. 6 shows a third embodiment of the fastening device in which the strap 1 is maintained by wedging. The blocking mechanism 3 includes a frame 28 that has a bottom 31. Moreover, the blocking mechanism 3 includes a wedging element 29 which is movably translationally mounted in a recess 30, partially shown in dotted lines in the frame 28. The wedging element 29 is positioned above the bottom 31 so as to make it possible to insert the portion S1 of the strap 1 between the wedging element 29 and the bottom 31 of the frame 28. Moreover, the wedging element 29 is connected to the end E2 of the strap 1 on the portion S2 which comes out of the return 2. The wedging element 29 can advantageously include teeth 132 positioned on the surface of the wedging element 29 facing the bottom 31 of the frame 28. This constructional arrangement increases the wedging of the strap 1, because the teeth 132 penetrate into the latter. A pull-tab 11 is also fixed on the wedging element 29 to enable the unblocking of the device.

To guarantee the functional requirements of the blocking mechanism 3, the recess 30 has a specific geometry which emphasizes three positions where the wedging element 29 can be placed in abutment, either under the tractional action of the strap 1, or under the action exerted on the pull-tab 11. The first position is a blocking position 50 in which the wedging element 29 wedges the strap 1 against the bottom 31 of the frame 28. The second position is a fastening position 51 in which the user pulls on the pull-tab 11, along a direction oriented substantially toward the end E1 of the strap 1. This action moves the wedging element 29 upward by unblocking the strap 1 and slides the blocking device 3 toward the end E1. The third position is a loosening position 52 in which the force of the user on the pull-tab 11, along a direction oriented substantially toward the return 2, moves the wedging element upward by unblocking the strap, and slides the blocking device 3 toward the return 2.

The previously described function is ensured if the wedging element 29, in the fastening position 51 and loosening position 52, releases a larger space with respect to the bottom 31 of the frame 28 than the space released by the wedging element 29 in the blocking position 50. This minimum condition is repeated in the preferred embodiment shown in FIG. 6. The recess 30 reassumes a shape of a boomerang having two arms, with a position 50, 52 of the wedging element 29 at the end of each of the two arms, and another position 51 at the junction of the two arms. The shape of the recess 30 is oriented so that the fastening position 51 is higher than the loosening position 52, which is in turn higher than the blocking position 50. Moreover, the fastening position 51 is located closer to the end E1 of the strap 1 than the blocking position 50 and the loosening position 52.

Respecting this constructional arrangement makes it possible to have an arm of the recess 30 that is inclined downward and toward the return 2, and in which the blocking position 50 is located at the bottom. The frame 28 is frictionally maintained fixed on the object to be tightened, on the one hand, and the shape of the arm of the recess 30 transforms the horizontal tension in the portion S2 of the strap 1 into a vertical force that nests the teeth 132 in the strap 1, on the other hand. This arrangement therefore enables a self-blocking of the wedging element 29 on this strap 1 when the portion S2 of the strap 1 is tensioned. In addition, the pull-tab 11 can advantageously be obtained by a loop strap in which the user slips a finger to manipulates the wedging element 29. It can advantageously be positioned on the wedging element 29, opposite the fastening point of the end E1 of the strap 1.

Figure 7:
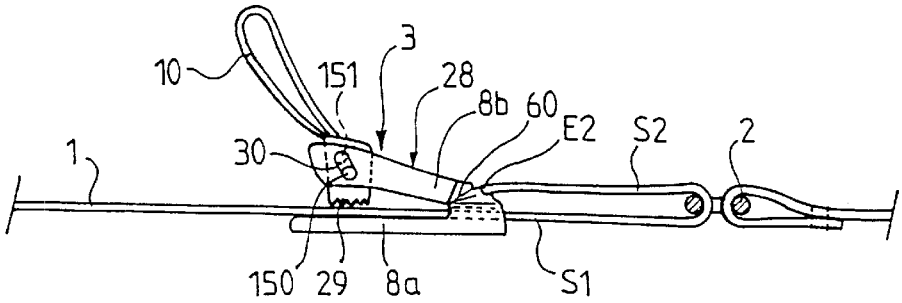
FIG. 7 schematically shows a side view of the fastening device according to a second variation of the second embodiment.

FIG. 7 shows a variation of the second embodiment which repeats the device of the wedging element 29 that is translationally movable with respect to the frame 28 in a recess 30. The geometry of this recess 30 is similar to the arm which includes the blocking 150 and moving 151 position. Thus, the function of blocking the strap 1 is ensured in a manner identical to that which has been previously described. The only difference relates to the fastening and loosening functions.

The frame 28, which constitutes the blocking mechanism 3, includes a jaw 8*b* in which is positioned the recess 30, as well as a jaw 8*a*, which is located beneath the jaw 8*b*. These two jaws 8*a* and 8*b* are connected by at least one bending zone 60 which enables the opening of the jaws 8*a*, 8*b* by using the elastic deformation of this bending zone 60. The bending zone 60 includes an opening which makes it possible to pass the portion S1 of the strap 1 between the jaws 8*a* and 8*b*. The strap 1 then passes in the return 2 and comes to be fixed, in the area of its end E2, on the frame 28. This fastening point is placed as low as possible so that the tension in the portion S2 does not open the jaws 8*a* and 8*b*. The end E2 is advantageously fixed in the area of the bending zone 28.

To ensure the fastening and loosening of the device, a pull-tab 10 is fixed on the wedging element 29. The action of the user on the pull-tab 10 is oriented substantially upward to lift the wedging element 29. The wedging element 29 slides in the recess 30 so as to be in abutment on the frame 28, in the moving position 151 which is located at the top of the recess 30. The user's action then contributes to spacing the jaws 8*a*, 8*b* apart by elastic deformation of the bending zone 60. The user then slides the frame 28 along the strap 1 by inclining, on either side, the action of his hand on the pull-tab 10.

Figure 8:
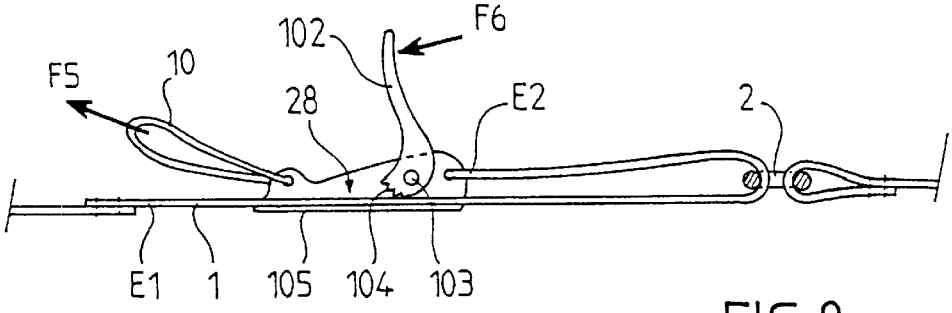
FIG. 8 schematically shows a longitudinal cross-section of the fastening device according to a third variation of the second embodiment.

FIG. 8 shows another variation of the second embodiment in which the means for maintaining the frame 28 on the strap 1 are independent of the means for sliding along the strap 1. The frame 28 includes a bottom 105 above which a closure lever 102 is rotationally mounted on an axle 103. This closure lever 102 includes, in its lower portion, teeth 104 which reinforce the fastening on the strap 1. The fastening is ensured by the lever 102 which pinches the strap 1 against the bottom 105 of the frame 28. This pinching is obtained in a known fashion by pivoting of the closure lever 102. This causes a reduction in the free space left between the base of the lever 102 and the bottom 105 of the frame 28. The sliding of the frame 28 along the strap 1 is obtained by an action F5 of the user on the pull-tab 10 which is fixed on the frame 28. This pull-tab 10 is positioned on the side of the end E1 of the strap 1 to exert a fastening action 1. Moreover, the closure lever 102 is advantageously closed by a tilting toward the end E1 under the action of a force F6. Thus, the forces F5 and F6, exerted by the user during the fastening and the closure of the device, are substantially oriented along the same direction. For example, the user positions his/her index finger in the pull-tab 10 and slides the frame 28 in a direction applying a force F5 to tighten the device, then actuates the closure lever with the thumb of the same hand along a direction applying a force F6. In order for the fastening to function, the end E2 of the strap 1 that extends from the return 2 is naturally fixed to the frame 28 according to the previously described functioning. Other devices known to a person with ordinary skill in the art are also contemplated for obtaining the function for blocking the strap 1.

Figure 9:
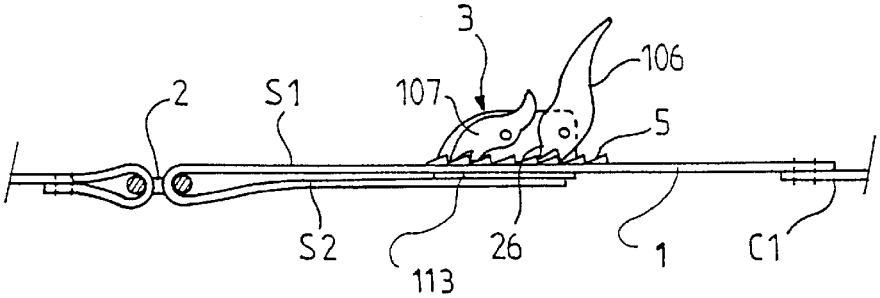
FIG. 9 schematically shows a cross-section of the fastening device according to a third embodiment.

FIG. 9 shows a third embodiment in which the portion S1 of the strap 1, which connects the portion C1 of the sports article to the return 2, is located above the portion S2 of the strap 1, which connects the return 2 to the blocking mechanism 3. The portion S2 is fixed on the bottom 113 of the blocking mechanism 3. The blocking function on the strap 1 is obtained by a cooperation between the blocking mechanism 3 which includes at least one tooth 26, and notches 5, which are positioned on the portion S1 of the strap 1. The tooth 26 is complementary to the notches 5. The teeth 26 are positioned on a displacement lever 106 which is hinged in a known manner on the blocking mechanism 3. Similarly, the blocking mechanism 3 includes a reverse-lock ratchet 107 which cooperates in a known manner with the notches 5 of the strap 1. The reverse-lock ratchet 107 also applies the portion S1 against the bottom 113 of the blocking mechanism 3. A portion of the strap 1 which includes the notches 5, in the area of the portion S1, can advantageously be made of a rigid material, in particular injected plastic such as polyamide.

Figure 10:
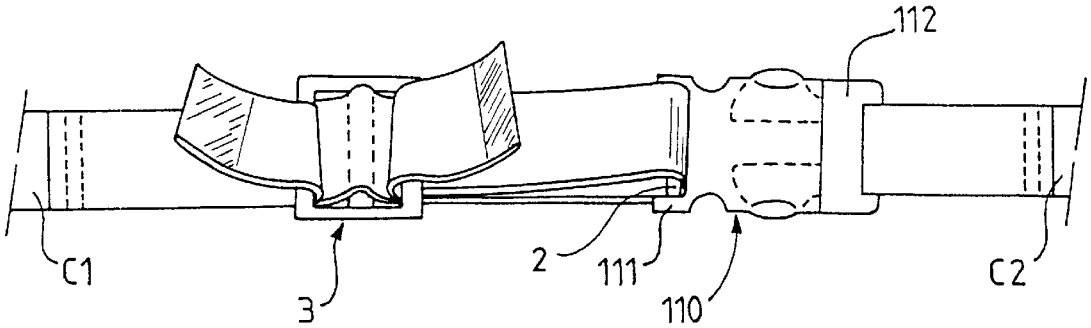
FIG. 10 schematically shows a top view of the fastening device according to an improvement to one of the embodiments.

FIG. 10 shows an improvement to one of the previous embodiments as well as their variations. The objective of this improvement is to make it possible to more easily release the tightened object once the device has been loosened. To achieve this objective, a snap buckle 110 is associated with the fastening device described. This buckle 110, which includes two elements 111, 112, complementary by nesting, makes it possible to open the fastening performed on the object to be held, if necessary.

In the preferred embodiment shown, the return 2 is integrated into the portion 111 of the buckle 100 and, therefore, the complementary portion 112 is fixedly connected, in the manner of a non-adjustable strap, to the portion C2 of the sports article. Thus, the opening function is ensured by the buckle 110 whose position is not adjustable, and the fastening function is performed by the previously described fastening device which is presented by the blocking device 3.

The position of the buckle 100 with respect to the blocking device 3 can be inverted, but it is necessary to conserve the return 2.

The present invention is not limited to the specific embodiments described hereinabove, which are provided for guidance only, but encompasses all similar or equivalent embodiments. In particular, it applies to a strap fastening system in which one wishes to prevent the free strap portions from dangling.

The fastening device can be applied to any use adapted to tighten an object. Therefore, in addition to the areas of application previously described, it can apply, for example, to backpacks, especially for ski-holders, snowboard-holders, compression straps, as well as to flap closure systems and belts for backpacks.

The instant application is based upon French Patent Application No. 00 04372, filed on Apr. 3, 2000, the disclosure of which is hereby incorporated by reference thereto in its entirety, and the priority of which is hereby claimed under 35 U.S.C. §119.

What is claimed is:

1. A fastening device for sports article including two portions adapted to be brought closer together, said device comprising:

a strap having a first end and a second end, the first end of the strap being connected to a first portion of the two portions of the sports article;

a return connected to a second portion of the two portions of the sports article, the return defining a portion of the strap positioned between the first end of the strap and the return;

a blocking mechanism fixed to the second end of the strap, the blocking mechanism being in cooperation with the portion of the strap for fastening, the blocking mechanism being slidably mounted on the portion of the strap.

2. A fastening device according to claim 1, wherein the blocking mechanism frictionally cooperates with the strap, in the area of the portion, for blocking.

3. A fastening device according to claim 1, wherein the strap is elastic.

4. A fastening device according to claim 1, wherein the blocking mechanism includes a pull-tab that makes it possible to slide the blocking mechanism on the strap and to bring the portions closer together for fastening.

5. A fastening device according to claim 1, wherein the blocking mechanism includes a pull-tab that makes it possible to slide the blocking mechanism on the strap and to space the portions apart for loosening.

6. A fastening device according to claim 4, wherein at least one pull-tab includes a hooking surface of the self-gripping type so as to ensure a fastening of the pull-tab on the strap or on the sports article.

7. A fastening device according to claim 1, wherein the blocking mechanism is constituted of a buckle that includes a first edge to which the second end of the strap is connected, a crosspiece and a second edge, the strap covering the edges on a same side, and that it covers the crosspiece on the opposite side, while extending through the buckle on both sides of the crosspiece.

8. A fastening device according to claim 1, wherein the strap includes a band, fixed on the strap, the band having a different frictional characteristic than that of the strap.

9. An article of footwear equipped with a fastening device according to claim 1.

10. A backpack equipped with at least one compression strap including a fastening device according to claim 1.

11. A glove equipped with a fastening device, in an area of the wrist, according to claim 1.

12. Trousers equipped with a fastening device, in an area of a lower portion of a leg of a wearer, according to claim 1.

13. A jacket equipped with a fastening device, in an area of a lower portion of a sleeve, according to claim 1.

14. A ski and snowboard holder for a backpack equipped with a fastening device according to claim 1.

15. A belt for a backpack equipped with a fastening device according to claim 1.

16. A fastening device according to claim 1, further comprising:

a first pull-tab extending from a first side of the blocking mechanism for sliding the blocking mechanism on the strap in a first direction to bring the two portions of the sports article closer together for fastening; and a second pull-tab extending from a second side of the blocking mechanism for sliding the blocking mechanism on the strap in a second direction to space the two portions of the sports article apart for loosening.

17. A fastening device according to claim 1, wherein the return further defines a second portion of the strap positioned above the first portion of the strap, and wherein neither of said first and second portions of said strap has a free end.

18. A fastening device according to claim 1, wherein the return further defines a second portion of the strap positioned above the first portion of the strap, and wherein the second portion of the strap is fixedly connected to the blocking mechanism against sliding relative to the blocking mechanism.

19. An article of footwear comprising:

a sole;

two portions transversely spaced apart above said sole;

a fastening device interposed between said two portions of the article of footwear for fastening a foot of a wearer to the article of footwear supported upon said sole, said fastening device comprising:

a strap having a first end and a second end, the first end of said strap being connected to a first portion of said two portions of the sports article;

a return connected to a second portion of said two portions of the sports article, said strap extending through said return and thereby defining a first portion of said strap extending from said return to said first end of said strap and a second portion of said strap positioned above said first portion of said strap;

a blocking mechanism slidably mounted on said first portion of said strap, said second portion of said strap being connected to said blocking mechanism, whereby:

a sliding movement of said blocking mechanism toward said return lengthens said first portion of said strap and shortens said second portion of said strap, thereby loosening said fastening device; and a sliding movement of said blocking mechanism away from said return shortens said first portion of said strap and lengthens said second portion of said strap, thereby tightening said fastening device.

20. An article of footwear according to claim 19, wherein neither of said first and second portions of said strap has a free end.

21. An article of footwear according to claim 19, wherein said second portion of said strap is fixedly connected to said blocking mechanism against sliding relative to said blocking mechanism.

22. An article of footwear according to claim 19, wherein said two portions of the article of footwear are positioned in an instep area.

23. An article of footwear according to claim 19, wherein said strap is elastic.

24. An article of footwear according to claim 19, further comprising:

a first pull-tab extending from a first side of said blocking mechanism for sliding said blocking mechanism on said first portion of said strap in a first direction to bring said two portions of the article of footwear closer together for fastening; and a second pull-tab extending from a second side of said blocking mechanism for sliding said blocking mechanism on said first portion of strap in a second direction to space said two portions of the article of footwear apart for loosening.

25. An article of footwear according to claim 24, wherein at least one of said pull-tabs includes a hooking surface of the self-gripping type so as to ensure a fastening of the pull-tab on said strap or on the article of footwear.

26. An article of footwear according to claim 19, wherein said blocking mechanism comprises a buckle having a first edge to which said second end of said strap is connected, a crosspiece and a second edge, whereby said strap is further connected to said buckle by covering said first and second edges on a same side of said buckle, and by covering said crosspiece on a side opposite said same side, and by extending through said buckle on both sides of said crosspiece.

27. A fastening device according to claim 1, further comprising a snap buckle, the snap buckle comprising two complementary elements the return being an integral part of a first of the two elements of the snap buckle, the second of the two elements of the snap buckle being connected to the first portion of the sports article.

28. A fastening device according to claim 7, wherein the pull-tab is fixed to the crosspiece of the buckle and ensures both the fastening and loosening of the device.

29. A fastening device according to claim 7, wherein the pull-tab includes a hooking structure, complementary to a retaining structure fixed on the buckle, which is adapted to perfect the blocking of the strap by piniching the strap between the pull-tab and one of the edges of the buckle.

30. A fastening device according to claim 1, wherein at least a part of the portion of the strap has notches, and wherein the blocking mechanism includes at least one tooth complementary to the notches.

31. A fastening device according to claim 30, wherein at least the part of the portion of the strap that includes the notches is made of a rigid material.

32. A fastening device according to claim 1, wherein the blocking mechanism includes a support base and a flexible blade that block the strap by pinching against the support base.

33. A fastening device according to claim 32, wherein the pull-tab is fixed to the flexible blade to enable the lifting of the blade and the unblocking of the device.

34. A fastening device according to claim 1, wherein the blocking mechanism includes a frame and a wedging element that is movably translationally mounted in a recess of the frame so as to wedge the strap between the wedging element and the bottom of the frame.

35. A fastening device according to claim 34, wherein the pull-tab is fixed to the wedging element to enable the unblocking of the device.

36. A fastening device according to claim 34, wherein the recess has a shape that emphasizes three positions; blocking, fastening, and loosening, and wherein the wedging element in the fastening and loosening positions releases a larger space, with respect to the bottom of the frame, than the wedging element in the blocking position.

37. A fastening device according to claim 34, wherein the frame includes a jaw that has the recess and a jaw against which the strap is wedged, and wherein the two jars are connected by at least one bending zone that facilitates the opening of the jaws, and therefore the unblocking of the device.

* * * * *